US007833084B2

(12) United States Patent
Hirashima

(10) Patent No.: US 7,833,084 B2
(45) Date of Patent: Nov. 16, 2010

(54) GARMENT WITH BREAST CUPS, SUCH AS BRASSIERE

(75) Inventor: Toshifumi Hirashima, Kosai (JP)

(73) Assignee: Yugenkaisha Chouryu, Shizuoka (JP)

( * ) Notice: Subject to any disclaimer, the term of this patent is extended or adjusted under 35 U.S.C. 154(b) by 440 days.

(21) Appl. No.: 11/814,525

(22) PCT Filed: Mar. 30, 2006

(86) PCT No.: PCT/JP2006/306650

§ 371 (c)(1),
(2), (4) Date: Jul. 23, 2007

(87) PCT Pub. No.: WO2006/106820

PCT Pub. Date: Oct. 12, 2006

(65) Prior Publication Data

US 2009/0017723 A1 Jan. 15, 2009

(30) Foreign Application Priority Data

Apr. 4, 2005 (JP) ..... 2005-002896
Feb. 11, 2006 (JP) ..... 2006-001695

(51) Int. Cl.
*A41C 3/00* (2006.01)

(52) U.S. Cl. ..... 450/70; 450/75; 450/76

(58) Field of Classification Search ..... 450/1, 450/19–21, 70, 75, 76, 93
See application file for complete search history.

(56) References Cited

U.S. PATENT DOCUMENTS

| | | | | |
|---|---|---|---|---|
| 2,763,010 | A * | 9/1956 | Rosenthal | 450/70 |
| 3,203,423 | A * | 8/1965 | Champagne | 450/65 |
| 3,260,262 | A * | 7/1966 | Bruno | 450/70 |
| 3,353,540 | A * | 11/1967 | Erteszek | 450/65 |
| 3,393,681 | A * | 7/1968 | Sachs | 450/59 |
| 6,790,122 | B2 * | 9/2004 | Mitchell et al. | 450/66 |
| 6,899,591 | B2 * | 5/2005 | Mitchell | 450/65 |
| 6,918,812 | B2 * | 7/2005 | Giese | 450/65 |

FOREIGN PATENT DOCUMENTS

| | | |
|---|---|---|
| JP | 56-131251 | 3/1983 |
| JP | 58-38704 | 3/1983 |
| JP | 9-95806 | 4/1997 |
| JP | 10-292208 | 11/1998 |
| JP | 2003-313702 | 11/2003 |
| WO | WO 03/088774 | 10/2003 |

* cited by examiner

*Primary Examiner*—Gloria Hale
(74) *Attorney, Agent, or Firm*—McGlew and Tuttle, P.C.

(57) ABSTRACT

A garment with breast cups comprises breast cups, a forwardly facing base part and rearwardly facing base parts, wherein, for the purpose of providing a function of causing the breast cups to agree with the movement of breasts, an elastic function of the forwardly facing base part is superior to an elastic function of the rearwardly facing base parts. The garment with breast cups is preferably configured such that the garment with breast cups is further provided with suspender straps, and that an elastic function of the suspender straps is inferior to the elastic function of the rearwardly facing base part.

16 Claims, 2 Drawing Sheets

GARMENT WITH BREAST CUPS, SUCH AS BRASSIERE

TECHNICAL FIELD

The present invention relates to a garment with breast cups, such as a brassiere, and particularly to a garment which has a function of causing the breast cups to agree with the movement of the breasts caused by a change in chest circumference caused by breathing movement, by daily movement of the upper limbs, by gravity and the like.

BACKGROUND ART

A human body can be divided into the head, the upper limbs, the lower limbs, and the torso. Moreover, the front of the torso is divided into the chest region and the abdominal region. The chest region is constituted of the rib cage (a basket-like bone skeleton consisting of the breastbone, rib bones, and thoracic vertebra), the skeletal muscle group including the pectoral major muscle, the breasts, and the like. The rib cage is moved mainly in the vertical direction by breathing movement, and the skeletal muscles of the chest region, such as the pectoral major muscle, are also moved mainly in the vertical direction by daily movement of the upper limbs. Although the breasts cannot move by themselves, the breasts are positioned at an upper layer of the chest region, and thus can be moved under the influence of the vertical movement of the rib cage and the skeletal muscles of the rib cage, and under the influence of the gravity. Specifically, in the torso, the breasts move most significantly under the influence of breathing movement, daily movement of the upper limbs, and gravity. Moreover, a change in chest circumference accompanied by breathing movement is caused by a movement of the breastbone, rib bones and thoracic vertebra, which are the bones constituting the rib cage. Particularly, regarding movements of the breastbone and thoracic vertebra, the vertical movement of the breastbone is larger than the vertical movement of the thoracic vertebra due to the structures thereof. Specifically, a change in chest circumference accompanied by the breathing movement mainly occurs at the front of the rib cage, instead of the back of the rib cage. In other words, a change in chest circumference accompanied by breathing movement and the like does not occur evenly at the entire rib cage, but occurs most significantly at the precordial region that covers a forwardly facing base part of a garment with breast cups, such as a brassiere with breasts.

However, a conventional garment such as a brassiere that has a breast cups is configured such that a forwardly facing base part of a precordial region is constituted of a non-elastic material (a material having a small or substantially no elastic function), and a rearwardly facing base part of a back region is constituted of an elastic material (a material having a large elastic function). This means that the non-elastic and elastic functions of the forwardly and rearwardly facing base parts of the conventional garment such as a brassiere that has breast cups are not suitable for causing the breast cups to agree with the movement of the breasts moving under the influence of a physical change in chest circumference accompanied by breathing movement, by a movement of the skeletal muscles of the chest region accompanied by daily movement of the upper limbs, and by gravity. For this reason, the conventional garment such as a brassiere that has breast cups has a problem that the breast cups cannot agree with the movement of the breasts accompanied by breathing movement, by daily movement of the upper limbs, by gravity and the like.

DISCLOSURE OF THE INVENTION

An object of the present invention is to provide a garment with breast cups, such as a brassiere, which can cause the breast cups to agree with the movement of the breasts accompanied by a change in chest circumference occurring during breathing movement, by movement of the skeletal muscles including pectoral major muscle of the chest region that occurs during daily movement of the upper limbs, and by gravity.

A garment with breast cups of the present invention, such as a brassiere, is a garment with breast cups which is constituted of breast cups, a forwardly facing base part and rearwardly facing base parts, wherein, for the purpose of providing a function of causing the breast cups to agree with the movement of breasts, an elastic function of the forwardly facing base part is superior to an elastic function of the rearwardly facing base parts.

The garment with breast cups is preferably configured such that the garment with breast cups is provided with a breast support between the breast cups and the forwardly facing base part, that the garment with breast cups is provided with suspender straps, that the breast cups are connected to the forwardly facing base part, and the forwardly facing base part is connected to the rearwardly facing base parts, or that each of the rearwardly facing base parts is directly coupled to a part of an external section of each of the breast cups and a part of an external section of the breast support, and that an elastic function of the suspender straps is inferior to the elastic function of the rearwardly facing base part.

According to the garment with breast cups of the present invention, such as a brassiere, the breast cups are caused to agree with the movement of the breasts which is caused under the influence of a change in chest circumference during breathing movement, movement of the skeletal muscles including pectoral major muscle of the chest region that occurs during daily movement of the upper limbs, and gravity, whereby the load generated by a breathing function and a movement function when the garment is worn can be reduced, and effects of expressing a natural movement of the breasts can be obtained without causing the garment to inhibit the breathing movement or daily movements of the upper limbs, such inhibition being caused because the conventional garment with breast cups, such as a brassiere, lacks the function of causing the breast cups to agree with the movement of the breasts.

BEST MODE FOR CARRYING OUT THE INVENTION

The present invention is based on a configuration in which the elastic function of the forwardly facing base part is superior to the elastic function of the rearwardly facing base parts, the forwardly facing base part and the rearwardly facing base parts configuring a garment having breast cups, such as a brassiere.

Hereinafter, embodiments of the present invention are described with reference to the drawings, but the present invention is not limited to these embodiments.

Figure 1:
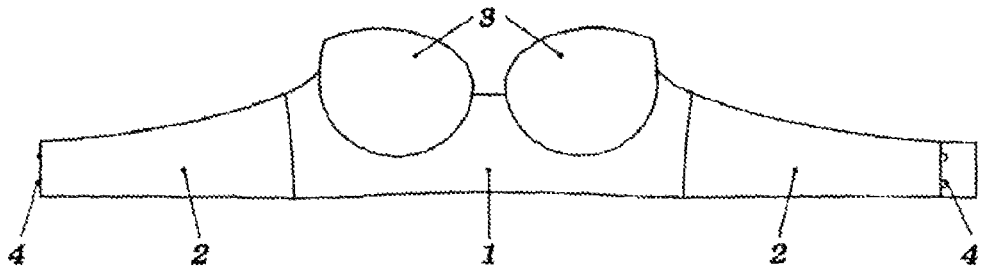
FIG. 1 is an explanatory front diagram of a brassiere, which shows an embodiment of the present invention.

In FIG. 1, the reference numeral 1 represents a forwardly facing base part, the reference numeral 2 represents rearwardly facing base parts, and the reference numeral 3 represents breast cups. Although the breasts cannot move by themselves, the breasts are positioned at an upper part of the torso, and thus are moved most significantly at the upper part of the torso under the influence of a change in chest circumference during breathing movements, daily movements of the upper limbs, and gravity. Also, the breasts can be deformed easily by external pressure or the like due to the shape and tissue characteristics of the breasts. Therefore, a function of causing the breast cups 3 to agree with the movement of the breasts plays an important role in expressing the movement of the breasts, which is required as one function of a brassiere. As described above, in a conventional brassiere, the forwardly facing base part in the precordial region is made of a non-elastic material and the rearwardly facing base part of the back region is made of an elastic material, while, in the present invention, an elastic material having an elastic function is used in the forwardly facing base part 1 disposed below the breast cups 3, and, in the rearwardly facing base parts 2, which are formed by using material, an elastic function of which in the horizontal direction is inferior to the elastic function of the forwardly facing base part 1. It should be noted that the reference numeral 4 represents hooks provided at a rear end portion of each of the rearwardly facing base parts 2.

As the above-mentioned elastic materials, the ones exerting different elastic functions depending on the woven parts, the ones obtained by weaving elastic strings or the like, or other elastic materials are used appropriately.

Figure 2:
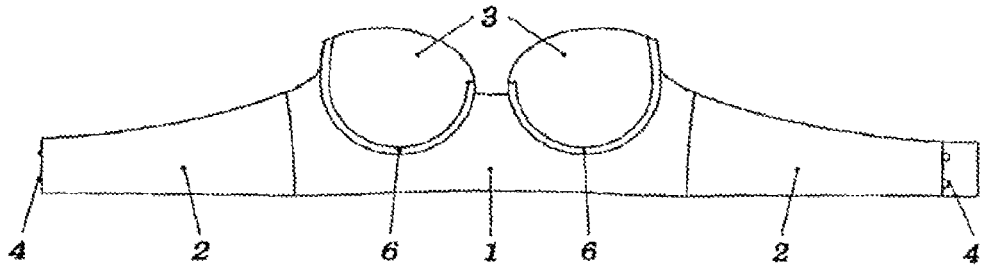
FIG. 2 is an explanatory front diagram of the brassiere, which shows another embodiment of the present invention.

In another embodiment of the present invention shown in FIG. 2, a breast support 6 is provided between the breast cups 3 and the forwardly facing base part 1. A conventionally known breast support is used as this breast support, and the shape thereof can be changed appropriately.

Figure 3:
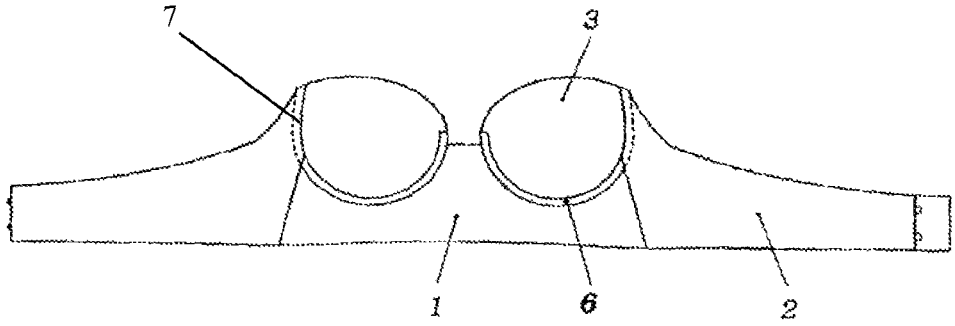
FIG. 3 is an explanatory front diagram of the brassiere, which shows a third embodiment of the present invention.

In FIG. 1 and FIG. 2, the breast cups 3 are attached to the forwardly facing base part 1, but the breast cups 3 may be attached to both the forwardly facing base part 1 and the rearwardly facing base part 2, as shown in FIG. 3. FIG. 3 shows an example in which the breast supports are used, but it is not a problem even if the breast supports are not used. An breast cup external section 7 of each of the breast cups 3 is attached to one of the rearwardly facing base parts 2.

Figure 4:
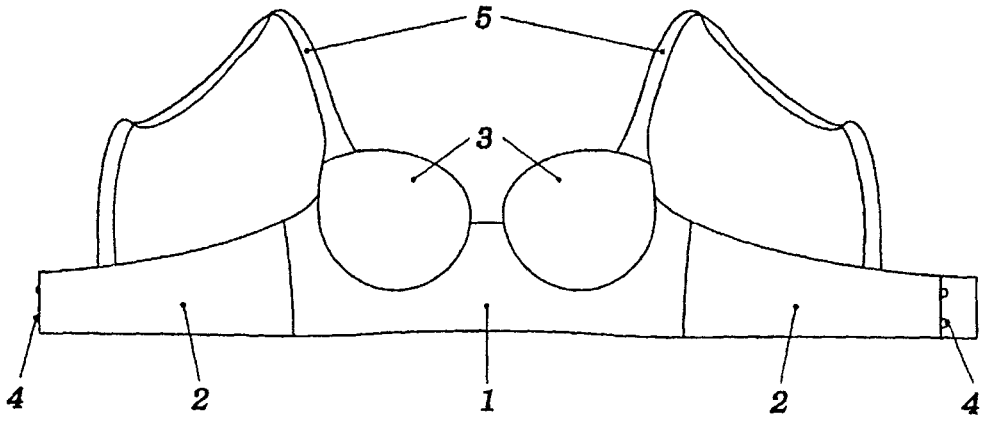
FIG. 4 is an explanatory front diagram of the brassiere, which shows a fourth embodiment of the present invention.
Figure 5:
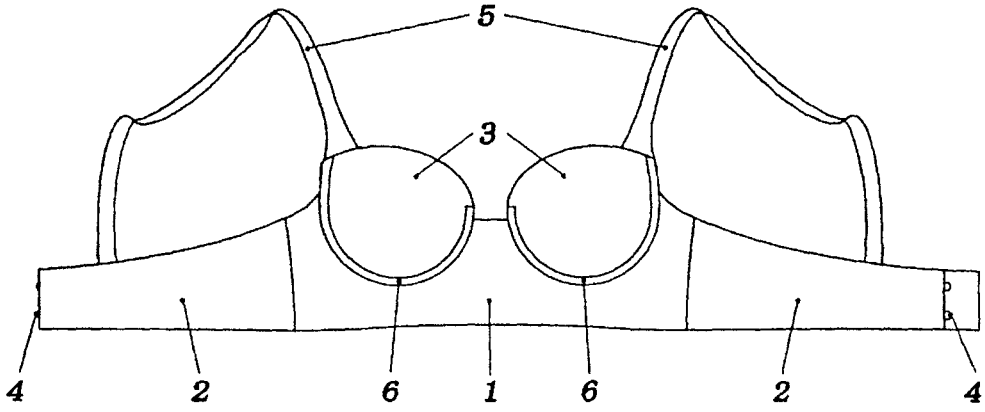
FIG. 5 is an explanatory front diagram of the brassiere, which shows a fifth embodiment of the present invention.

FIG. 4 and FIG. 5 each show an embodiment of the present invention in which suspender straps 5 are provided. The garment of the present invention that has breast cups, such as a brassiere, uses an elastic material having a large stretchable function at the forwardly facing base part, thus the suspender straps 5 are not always required for causing the breast cups 3 to agree with the movement of the breasts. However, by providing the suspender straps 5, the function of causing the breast cups 3 to agree with the vertical movement of the breasts can be further improved.

FIG. 4 shows an example of a brassiere without the breast supports, wherein each of the suspender straps 5 is extended to be connected from an upper end of an external section of each of the breast cups 3 to an upper rim of each of the rearwardly facing base parts 2. Also, FIG. 5 shows an example of a brassiere having the breast supports, wherein each suspender strap 5 is extended to be connected from an intersection where an upper end of an external section of each breast support 6 intersects with the upper end of the external section of each breast cup 3, to the upper rim of each rearwardly facing base part 2.

Furthermore, FIG. 4 and FIG. 5 each show that the breast cups 3 are connected to the forwardly facing base part 1. However, the configuration of the brassiere is not limited to this configuration, thus the breast cups may be connected to both the forwardly facing base part and the rearwardly facing base part. Specifically, in the case of a brassiere having the suspender straps, the presence/absence of the breast supports and the pattern of connecting the breast cups to the forwardly facing base part or the rearwardly facing base part are not particularly limited.

The hooks 4 are provided at a position where the sum of the length of the forwardly facing base part 1 and the length of the rearwardly facing base part 2 when the garment is not worn (no loads applied) is equal to the minimum chest circumference value when a wearer wears the garment and exhales in a horizontal sectional direction.

Also, the elastic function in the horizontal direction of the forwardly facing base part 1 desirably generates stretching force, at which the wearer does not feel overloaded at the maximum chest circumference value that is obtained when the wearer inhales.

When the wearer attaches the breast supports 6 to the underbust position, it is preferred that the entire length of the suspender straps 5 be set to the minimum distance that does not affect the stretchability of the forwardly facing base part 1 in the vertical section, without raising the position of attachment of the rearwardly facing base parts 2. Furthermore, it is further preferred that the elastic function of the forwardly facing base part 1 in the vertical direction generate stretching force at which the wearer does not feel overloaded when the shoulder positions are raised by elevation of the upper limbs of the wearer. In this manner, changes in chest circumference in the horizontal direction, which are caused by breathing movement of the rib cage, can be handled by the elastic function of the forwardly facing base part 1 in the horizontal direction, and movement in the vertical direction that is accompanied by the daily movement of the upper limb and gravity can be handled by the elastic function of the forwardly facing base part 1 in the vertical direction, thus it is possible to easily obtain an adequate function of causing the breast cups 3 to agree with the movement of the breasts accompanied by a change in chest circumference occurring during breathing movement, by daily movement of the upper limbs, by gravity and the like.

INDUSTRIAL UTILIZABILITY

The loads generated by the breathing behavior and the movement function when the garment is worn can be reduced by causing the breast cups to agree with the movement of the breasts and without causing the garment to inhibit the breathing movement or daily movement of the upper limbs. Specifically, a garment with breast cups, such as a brassiere, which prevents displacement of the breast cups, reduces discomfort when the garment is worn, and allows the wearer to express natural movement of the breasts, can be supplied, contributing to women's garment industry.

The invention claimed is:

1. A woman's garment comprising:

breast cup parts;

a forwardly facing base part connected to said breast cup parts, said forwardly facing base part facing a front portion of a user;

rearwardly facing base parts connected to said forwardly facing base part, at least a portion of each of said rearwardly face base parts facing at least a rear portion of the user; and suspender straps, each of said suspender straps being connected to one of said breast cups, wherein a material forming said forwardly facing base part has a stretchability that is greater than a stretchability of a material forming said rearwardly facing base parts, and wherein a material forming said suspender straps has a stretchability that is lower than said stretchability of said material forming said rearwardly facing base parts.

2. A woman's garment in accordance with claim 1, further comprising a breast support arranged between said breast cup parts and said forwardly facing base part.

3. A woman's garment in accordance with claim 1, wherein said at least said portion of one of said rearwardly facing base parts is located opposite said forwardly facing base part, said at least said portion of another one of said rearwardly facing base parts being located opposite said forwardly facing base part.

4. A woman's garment in accordance with claim 2, wherein each of said breast cup parts has a breast cup part external section, said breast support having an external breast support section, each of said rearwardly facing base parts being directly coupled to at least a portion of said breast cup part external section and at least a portion of said external breast support section.

5. A woman's garment in accordance with claim 1, wherein each of said suspender straps is connected to one of said rearwardly facing base parts.

6. A garment, comprising:

a plurality of breast cups;

a forwardly facing base part comprising a forwardly facing base part material, said breast cups being connected to said forwardly facing base part, said forwardly facing base part being arranged opposite a front portion of a user, said forwardly facing base part material having a forwardly facing base part material stretchability;

a plurality of rearwardly facing base parts connected to said forwardly facing base part, at least a portion of each of said rearwardly facing base parts being arranged opposite a rear portion of the user, each of said rearwardly facing base parts comprising a rearwardly facing base part material, said rearwardly facing base part material having a rearwardly facing base part material stretchability;

a plurality of suspender straps, each of said suspender straps being connected to one of said breast cups, each of said suspender straps comprising a suspender strap material, said suspender strap material having a suspender strap stretchability, said forwardly facing base part material stretchability being greater than said rearwardly facing base part material stretchability, said suspender strap stretchability being less than said rearwardly facing base part material stretchability.

7. A garment in accordance with claim 6, further comprising a breast support arranged between said breast cups and said forwardly facing base part.

8. A garment in accordance with claim 6, wherein said at least said portion of one of said rearwardly facing base parts is located opposite one portion of said forwardly facing base part, said at least said portion of another one of said rearwardly facing base parts being located opposite another portion of said forwardly facing base part.

9. A garment in accordance with claim 7, wherein each of said breast cup parts has a breast cup part external section, said breast support having an external breast support section, each of said rearwardly facing base parts being directly coupled to at least a portion of said breast cup part external section and at least a portion of said external breast support section.

10. A garment in accordance with claim 6, wherein each of said suspender straps is connected to one of said rearwardly facing base parts.

11. A garment, comprising:

a brassiere structure comprising a plurality of breast cups and a plurality of body engaging portions, said plurality of body engaging portions comprising a front brassiere base portion, a first rear brassiere portion and a second rear brassiere portion, said front brassiere base portion being connected to said breast cups, said front brassiere base portion having a front body contacting surface for engaging at least a front portion of a body of a user, said first rear brassiere portion and said second rear brassiere portion comprising a rear body portion contacting surface for engaging at least a back portion of the body of the user, said front brassiere base portion comprising a front brassiere base portion material, said front brassiere base portion material having a front brassiere base portion material elasticity, said first rear brassiere portion comprising a first rear brassiere portion material, said first rear brassiere portion material comprising a first rear brassiere portion material elasticity, said second rear brassiere portion comprising a second rear brassiere portion material, said second rear brassiere portion material comprising a second rear brassiere portion material elasticity, said front brassiere base portion material elasticity being greater than said first rear brassiere portion material elasticity and said second rear brassiere portion material elasticity.

12. A garment in accordance with claim 11, wherein said brassiere structure comprises a plurality of straps, each of said straps comprising a strap material, said strap material comprising a strap material elasticity, one of said straps being connected to one of said breast cups and said first rear brassiere portion, another one of said straps being connected to another one of said breast cups and said second rear brassiere portion, said strap material elasticity being less than said first rear brassiere portion material elasticity and said second rear brassiere portion material elasticity.

13. A garment in accordance with claim 12, wherein said brassiere structure comprises a breast support arranged between said breast cups and said front brassiere base portion.

14. A garment in accordance with claim 12, wherein said front brassiere base portion is connected to said first rear brassiere portion and said second rear brassiere portion.

15. A garment in accordance with claim 14, wherein said first rear brassiere portion is located opposite said front brassiere base portion, said second rear brassiere portion being located opposite said front brassiere base portion.

16. A garment in accordance with claim 13, wherein each of said breast cups has a breast cup external section, said breast support having an external breast support section, said first rear brassiere portion and said second rear brassiere portion being directly coupled to at least a portion of said breast cup external section and at least a portion of said external breast support section.

* * * * *